US011801673B2

(12) United States Patent
Vasic et al.

(10) Patent No.: US 11,801,673 B2
(45) Date of Patent: Oct. 31, 2023

(54) SCREEN PROVISION SYSTEM

(71) Applicants: Exentis Group AG, Stetten (CH); EKRA Automatisierungssysteme GmbH, Bönnigheim (DE)

(72) Inventors: Srdan Vasic, Horgen (CH); Markus Engel, Moosen/Vils (DE); Franz Plachy, Brackenheim (DE); Hubert Reinisch, Freiberg am Neckar (DE)

(73) Assignees: EXENTIS GROUP AG, Stetten (CH); EKRA AUTOMATISIERUNGSSYSTEME GMBH, Bönnigheim (DE)

( * ) Notice: Subject to any disclaimer, the term of this patent is extended or adjusted under 35 U.S.C. 154(b) by 0 days.

(21) Appl. No.: 16/762,251

(22) PCT Filed: Nov. 9, 2018

(86) PCT No.: PCT/EP2018/080796
§ 371 (c)(1),
(2) Date: May 7, 2020

(87) PCT Pub. No.: WO2019/092194
PCT Pub. Date: May 16, 2019

(65) Prior Publication Data

US 2021/0178750 A1 Jun. 17, 2021

(30) Foreign Application Priority Data

Nov. 10, 2017 (EP) ..... 17201059

(51) Int. Cl.
*B41F 15/08* (2006.01)
*B41F 15/36* (2006.01)

(52) U.S. Cl.
CPC ..... *B41F 15/36* (2013.01); *B41F 15/085* (2013.01)

(58) Field of Classification Search
CPC ..... B41F 15/36; B41F 15/085
See application file for complete search history.

(56) References Cited

U.S. PATENT DOCUMENTS 2,610,577 A 9/1952 Heintges
4,173,928 A 11/1979 Mitter
(Continued)

FOREIGN PATENT DOCUMENTS

DE 26 43 226 A1 3/1978
DE 27 22 060 A1 11/1978
(Continued)

OTHER PUBLICATIONS

International Search Report and Written Opinion dated May 16, 2019 in Application No. PCT/EP2018/080796, filed Nov. 9, 2018.
(Continued)

*Primary Examiner* — Christopher E Mahoney
*Assistant Examiner* — Marissa Ferguson-Samreth
(74) *Attorney, Agent, or Firm* — Knobbe, Martens, Olson & Bear LLP

(57) ABSTRACT

A screen provision system, for a printing device with a screen receptacle for a printing screen-and a squeegee device associated with the screen receptacle, has a conveying device for conveying a printing screen and at least one screen magazine with multiple screen storage portions that can each receive a printing screen. The screen provision system has at least one treatment station for treating the printing screens. The conveying device supplies printing screens to the screen magazine and to the at least one treatment station.

15 Claims, 2 Drawing Sheets

(56) References Cited

U.S. PATENT DOCUMENTS

| | | | | |
|---|---|---|---|---|
| 4,223,602 | A | 9/1980 | Mitter | |
| 4,967,655 | A | 11/1990 | Holderegger | |
| 5,694,843 | A | 12/1997 | Chen | |
| 5,740,729 | A | 4/1998 | Hikita et al. | |
| 6,152,031 | A | 11/2000 | DeCruz | |
| 6,347,583 | B1 | 2/2002 | Isogai et al. | |
| 6,478,524 | B1 * | 11/2002 | Malin | B65G 1/0407 360/92.1 |
| 6,536,859 | B1 | 3/2003 | Bathe | |
| 6,579,381 | B1 * | 6/2003 | Moscatelli | B08B 3/022 134/28 |
| 7,748,317 | B2 | 7/2010 | Puig Vila et al. | |
| 11,396,131 | B2 | 7/2022 | Vasic et al. | |
| 2003/0154868 | A1 | 8/2003 | Mcevoy | |
| 2007/0081067 | A1 * | 4/2007 | Omori | B41J 15/044 347/108 |
| 2008/0229944 | A1 | 9/2008 | Koenig et al. | |
| 2009/0177309 | A1 | 7/2009 | Kozlak | |
| 2013/0038963 | A1 * | 2/2013 | Nespeca | G11B 15/6835 360/92.1 |
| 2014/0033886 | A1 | 2/2014 | Hoover et al. | |
| 2014/0117067 | A1 | 5/2014 | Sato | |
| 2014/0272191 | A1 * | 9/2014 | Wang | D06B 1/02 427/557 |
| 2015/0328838 | A1 | 11/2015 | Erb et al. | |
| 2017/0348912 | A1 | 12/2017 | Hirschberg | |
| 2018/0219111 | A1 | 8/2018 | Tsukigata et al. | |
| 2019/0337287 | A1 | 11/2019 | Fukakusa | |
| 2021/0170683 | A1 | 6/2021 | Vasic | |
| 2021/0178681 | A1 | 6/2021 | Vasic | |

FOREIGN PATENT DOCUMENTS

| | | | |
|---|---|---|---|
| DE | 42 26 502 | A1 | 2/1994 |
| DE | 199 36 572 | A1 | 2/2001 |
| DE | 10 34 4022 | | 4/2005 |
| DE | 20 2013 004 745 | U1 | 8/2014 |
| EP | 0 270 485 | A1 | 6/1988 |
| EP | 2 305 467 | A1 | 4/2011 |
| JP | H06-071847 | A | 3/1994 |
| JP | H06-305111 | A | 11/1994 |
| JP | H06-328659 | A | 11/1994 |
| JP | H07-125175 | A | 5/1995 |
| JP | 10171031 | * | 6/1998 |
| JP | 2000-238233 | A | 9/2000 |
| WO | WO 2016/095059 | | 6/2016 |
| WO | WO 2016/095060 | | 6/2016 |
| WO | WO 2019/092193 | A1 | 5/2019 |
| WO | WO 2019/092194 | A1 | 5/2019 |
| WO | WO 2019/092195 | A1 | 5/2019 |

OTHER PUBLICATIONS

International Preliminary Report On Patentability, dated May 12, 2020, in International Application No. PCT/EP2018/080796.

International Search Report & Written Opinion, dated Nov. 28, 2018, in International Application No. PCT/EP2018/080796.

International Search Report & Written Opinion, dated Dec. 20, 2018, in International Application No. PCT/EP2018/080795.

International Preliminary Search Report On Patentability, dated May 12, 2020, in International Application No. PCT/EP2018/080795.

International Search Report and Written Opinion dated May 16, 2019 in Application No. PCT/EP2018/080795, filed Nov. 9, 2018.

International Preliminary Report On Patentability, dated May 12, 2020, in International Application No. PCT/EP2018/080797.

International Search Report & Written Opinion, dated Dec. 20, 2018, in International Application No. PCT/EP2018/080797.

European Search Report dated Dec. 21, 2020 in EP Application No. 17 201 060.5.

Office Action in JP Application No. 2020-544132 dated Oct. 18, 2022.

Office Action in JP Application No. 2020-544131 dated Nov. 1, 2022 in 7 pgs.

Office Action dated Dec. 28, 2022 in KR Application No. 10-2020-7016195.

* cited by examiner

SCREEN PROVISION SYSTEM

PRIORITY AND CROSS REFERENCE TO RELATED APPLICATIONS

This application is the U.S. National Phase Application under 35 U.S.C. § 371 of International Application No. PCT/EP2018/080796, filed Nov. 9, 2018, designating the U.S. and published as WO 2019/092194 A1 on May 16, 2019, which claims the benefit of European Application No. EP 17201059.7, filed Nov. 10, 2017. Any and all applications for which a foreign or a domestic priority is claimed is/are identified in the Application Data Sheet filed herewith and is/are hereby incorporated by reference in their entireties under 37 C.F.R. § 1.57.

FIELD

The invention relates to a screen provision system.

BACKGROUND

Printing devices which apply a material layer having a structure determined by the printing screen to a substrate by means of a squeegee device and a printing screen—also referred to as a printing mask—are known from the prior art. For example, in order to produce printed circuit boards, it is known to print electrically-conductive structures onto a printed circuit board substrate by means of such a printing device. The use of the printing screen has the advantage that the structures can be applied multiple times to several substrates or even to one substrate in a simple manner Time and cost advantages are key. An alternative to this is to apply conductor track structures in a targeted manner by means of a spray nozzle, this being disadvantageous in terms of time and cost compared to the aforementioned printing device.

SUMMARY

The invention relates to a screen provision system—in particular, for a printing device, and, in particular, a 3-D screen printing device—having a screen receptacle for a printing screen and a squeegee device associated with the printing screen.

BRIEF DESCRIPTION OF THE DRAWINGS

The invention shall be explained in more detail below with reference to the drawings. Shown for this purpose are FIGS. 1-3.

DETAILED DESCRIPTION

Figure 1:
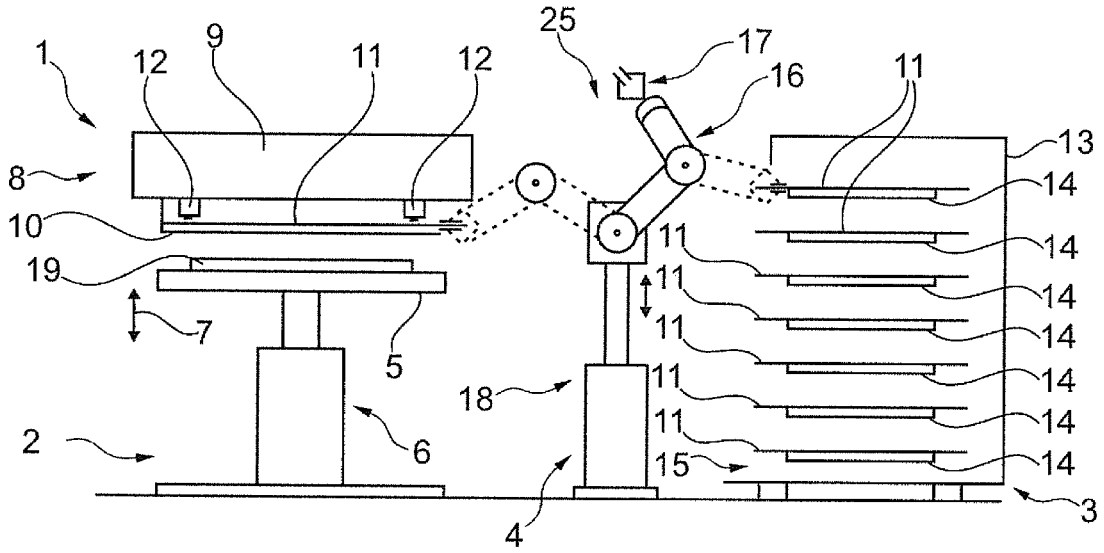
FIG. 1 shows an advantageous printing system in a simplified representation.

A disadvantage of screen printing devices is that different printing screens have to be used for the production of different structures. This means an increased outlay for the user because he has to replace the printing screen, clean it, and exchange it with a new printing screen which has to be refilled.

The aim of the invention is to provide a screen provision system which reduces the processing time, improves material utilization, and ensures a reliable printing process.

The aim underlying the invention is achieved by the provision device having the features of claim 1. This has the advantage that a printing screen is automatically made available for a printing process—in particular, for a printing of three-dimensionally-shaped structures—and, moreover, preparatory and post-processing steps are facilitated and, in part, completely avoided. As a result, the throughput of the printing device can be increased and the load on the user reduced, thereby not adversely affecting the printing result or the printing quality.

The screen provision system according to the invention is characterized in that it comprises a conveying device for conveying a printing screen in each case, and at least one screen magazine which has multiple screen storage portions for receiving a printing screen in each case, and, in particular, at least one treatment station for treating the printing screens, wherein the conveying device is designed to supply the at least one screen magazine and, in particular, the at least one treatment station with printing screens. The screen provision system thus has a screen magazine for receiving multiple printing screens. It is thus possible to store a plurality of identical and/or different printing screens in the screen magazine if they are not needed for a printing process at the moment. This centralized storage ensures simple handling of multiple printing screens. Preferably, the printing screens have markers and the screen magazine a recognition means for detecting the presence and position of printing screens in the screen magazine, so that, if necessary, the desired printing screen can be removed from the screen magazine in a simple manner In particular, existing printing screens can, in particular, be pre-treated or post-treated by the at least one treatment station in order to make the printing process of a printing device efficient. In particular, the treatment station is designed to take over activities otherwise the responsibility of the user and thereby simplify a printing process. Because the conveying device reaches or supplies both the treatment station and the screen magazine, the printing screens can be brought automatically by means of the conveying device from the screen magazine to the treatment station and vice versa, so that the pre- or after-treatment of a printing screen takes place automatically. Moreover, storage in the screen magazine has the advantage that cleaning of a printing screen does not necessarily have to take place after a printing process has been carried out. Instead, the printing screen is stored in the screen magazine with residues of printing compound remaining thereon until it is again required for a printing process with the same printing compound. A cleaning step can thereby also be completely dispensed with.

In a preferred embodiment of the invention, the screen provision system has a screen usage station which can be supplied by the conveying device with the printing screens. In this context, the screen usage station is understood to mean a station in which the screen is supplied to its actual destination. The user therefore does not have to remove a screen from the screen magazine himself and, for example, feed it to a printing device. Rather, a printing screen is automatically provided to the user and/or a printing device. Alternatively, the screen magazine is designed in such a way that the user himself removes a desired printing screen there. For this purpose, the screen magazine can be open on two sides, for example, wherein, on one side, the conveying device has access to the printing screens, and, from the other side, the users.

In a preferred embodiment of the invention, the screen usage station is a screen removal station for the user. The respectively selected printing screen is thus made available to the user at the removal station, so that he does not himself have to search for the appropriate printing screen in the magazine. In particular, the removal station has a screen storage portion in which the conveying device can store the selected printing screen for removal.

In an alternative embodiment of the invention, it is preferably provided that the screen usage station be a printing device. The conveying device is thus designed to supply a selected printing screen directly to a printing device for performing a printing operation. In particular, the conveying device is designed to insert the selected printing screen into the screen receptacle of the printing device or to arrange it there, so that a printing process can subsequently be carried out automatically. In particular, the printing device is designed for printing three-dimensionally-shaped structures, for which purpose the print head and/or a printing table can be adjusted in height, so that several layers of material can be produced by the screen printing. By an automated exchange of the printing screens, different three-dimensional structures are produced fully automatically in a simple manner.

A preferred further development of the invention provides for several screen magazines to be present. The number of storable printing screens is thereby increased, and the variance in the production of, in particular, three-dimensional printing structures is achieved. Advantageously, all screen magazines can be reached by the conveying device.

Preferably, at least one of the screen magazines or the at least one screen magazine has a conditioning device designed to generate and maintain a climate in the screen magazine, which prevents a drying of printing compound remaining on a printing screen. The conditioning device ensures that printing screens which are also in the screen magazine for a longer time and still have residues of printing compound can be reused without first having to be cleaned and filled again completely with printing compound. This both reduces the material consumption and shortens the processing time.

The conditioning device preferably has at least one humidifier and/or dehumidifier, by means of which the air located in the screen magazine can be humidified or dehumidified in order to establish an optimal climate in the screen magazine for the respective printing compound. If several screen magazines are present, several screen magazines can also each have a conditioning device, wherein the conditioning devices can then be designed to be different or identical, but can be operated differently. In this way, it can be achieved that, in each screen magazine, an optimal climate for the printing screens located there can be set. In particular, print screens used for printing with a first material are then stored in a first screen magazine, and print screens used with a second material are stored in a second screen magazine, so that an optimal climate setting is possible.

Furthermore, it is preferably provided that the conditioning device have at least one cooling device and/or heating device. This also helps to avoid drying and to ensure reuse of residual printing compounds on the printing screens, independently of ambient conditions. In a further embodiment of the invention, it is preferably provided that at least one screen magazine be divided into at least two sections, which can be conditioned differently by the conditioning device. In this way, different climates can be set in a screen magazine, which are selected, in particular, as a function of different printing compounds. Thus, printing compounds of materials such as ceramics, metals, polymers, biomaterials, alloys, composite materials, or other printable material combinations may be provided.

Furthermore, it is preferably provided that at least one screen magazine have at least one closing element which can be displaced in order to release or close a housing that encloses the screen storage portions. The screen magazine thus has a housing which houses the screen storage portions and can, in particular, be completely closed by a closing element. This simplifies the maintenance of a climate or conditioning in the screen magazine, since the set climate can be maintained longer. An actuator is, expediently, associated with the closing element, which actuator automates the closing or release of the screen storage portion. Alternatively, the conveying device is designed to actuate the closing element.

Furthermore, it is preferably provided that at least one screen magazine have at least one sliding device for advancing a selected printing screen from one of the screen storage portions. By means of the sliding device, a printing screen from a screen storage portion or a screen storage portion can be advanced, so that the printing screen can be gripped more easily by the conveying device and brought to the screen removal station or the use station or to a treatment station. In this case, the sliding device is designed, in particular, to advance the printing screen to such an extent that it projects beyond the housing of the screen magazine. In particular, the housing has a removal opening to which the closing element is assigned. The sliding device is assigned to the removal opening in such a way that it can advance a printing screen associated with the removal opening a small distance out of the removal opening on the housing so that it can be gripped by the conveying device. In order to feed a printing screen to the removal opening in the screen magazine, the screen storage portions in the screen magazine are, preferably, adjustable in height. For this purpose, there is, preferably, a lifting device in the screen magazine by means of which the screen storage portions can be raised or lowered in order to assign a selected printing screen to the removal opening or to assign an empty screen storage portion to the removal opening so that it can be covered with a printing screen. According to a preferred development of the invention, several treatment stations are present. These are all supplied by the conveying device. Different treatment steps can thereby be carried out by the screen provision system.

In particular, at least one treatment station is designed as a printing screen cleaning station. For this purpose, the printing screen cleaning station preferably has cleaning means by which a printing screen can be completely cleaned of any printing compound possibly remaining thereon. If, for example, it is known that a specific printing screen need no longer be used for a longer period of time, and there is the risk that aging of the printing compound remaining on the printing screen is to be feared due to the long period of time, the printing screen is fed by the conveying device to the screen cleaning station, cleaned, and deposited in the screen magazine.

According to a preferred embodiment of the invention, it is further provided that at least one treatment station be designed as a printing screen filling station, which serves to fill a printing screen with a desired printing compound before the printing screen is fed to the printing device. The effect achieved by this is that the printing compound outside the printing device is dispensed onto the printing screen. This also ensures that different print materials are applied to the print screens in a reliable manner In particular, the printing screen filling station has tanks for storing different materials for printing the printing screens. An intermediate step, such as the manual filling of a printing screen, can thus be dispensed with, and a mechanism in the printing device itself, which otherwise performs the filling of a printing screen, can also be dispensed with, whereby the printing device can be implemented in a space-saving, compact, and also cost-effective manner.

Furthermore, it is preferably provided that at least one treatment station be a control station. In particular, the control station is designed to measure a printing screen and to compare a structure/pattern predetermined by the printing screen with a reference pattern in order to detect damage to the printing screen. If damage is detected, the printing screen is no longer put back into the screen magazine, but instead is set aside. For this purpose, the control station preferably has a camera device for detecting the printing pattern or the structure, and a memory in which the reference pattern of the provided printing screens is stored in order to easily detect damage and/or a state of the respective printing screen by means of a comparison. Furthermore, the invention relates to a screen magazine for storing printing screens for a printing device, which has at least one conditioning device for setting or maintaining a climate in the screen magazine, and, in particular, is designed as described above.

FIG. 1 shows in a simplified side view a printing system 1 having a printing device 2, a screen magazine 3, and a conveying device 4.

The printing device 2 has a printing table 5, which is adjustable in height by a lifting device 6, as indicated by a double arrow 7. Associated with the printing table 5 is a print head 8, which has a squeegee device 9. In addition to a blade, which is not shown here in greater detail, the squeegee device 9 has a screen receptacle 10 in which a printing screen 11 can be arranged. For this purpose, the screen receptacle 10 is designed, for example, as a receptacle into which the printing screen 11 can be inserted—in particular, inserted laterally or horizontally—as shown in FIG. 1. Alternatively, the screen receptacle 10 is designed in such a way that the printing screen 11 can be inserted therein. Optionally, the screen receptacle 10 has controllable clamping elements 12 by means of which the printing screen 11 can be clamped fixedly in the screen receptacle 10 so that, in a printing process in which the blade of the squeegee device 9 is moved over the printing screen 11, the orientation and position of the printing screen 11 does not change.

The screen magazine 3 has a housing 13 and is arranged at a distance from the printing device 2 in the present case. In the housing 13, several screen storage portions 14 are arranged so as to be superimposed or stacked one above the other. The screen storage portions 14 are designed, for example, like the screen receptacle 10 and, optionally, also have the clamping elements 12. A printing screen 11 can be arranged in each screen storage portion 14. The housing 13 is essentially designed to be closed, but has, on a side facing the pressure device 2 in particular, a removal opening 15 through which a printing screen 11 can be introduced into or taken out of the housing 13.

The conveying device 4 is designed to move the printing screens 11. This has, in the present exemplary embodiment, a multi-link conveying arm 16 which carries a gripper 17 at its free end. The gripper 17 is designed, for example, pneumatically or mechanically, in order to grip a single printing screen 11. The conveying device 4 is arranged between the printing device 2 and the screen magazine 3 in such a way that the conveying arm 16 can reach both a printing screen 11 assigned to the removal opening 15 and a printing screen 11 placed in the screen receptacle 10. In the present exemplary embodiment, the removal opening 15 extends over nearly the entire height of the screen magazine 3, wherein the conveying arm 16 is designed in such a way that it can reach each screen storage portion 14 or the printing screen located therein. To this end, the conveying device 4 is optionally equipped with its own lifting device 18 in order to increase the freedom of movement of the gripper 17. Together with the screen magazine 3, the conveying device 4 forms a screen provision system 25 for the printing device 2.

The function of the advantageous printing system 1 is as follows. For printing three-dimensionally-shaped structures, the conveying device 4 is first controlled so as to remove a specific printing screen 11 from the screen magazine 3 and feed it to the screen receptacle 10. The printing screen 11 is locked in the screen receptacle 10 by means of the clamping means 12. A printing compound—in particular, a printing paste—of a selected material is then applied to the printing screen 11, and a blade of the squeegee device 9 is pushed over the printing screen 11 so that the printing compound is imprinted onto the printing table through the printing screen 11. In this case, it is conceivable for the printing compound to be applied directly to the printing table 5 or to a substrate 19 arranged on the printing table 5 which may, for example, be designed as a carrier substrate, or also as a printed circuit board, wafer or the like. For this purpose, the printing screen 11 has, in certain areas, screen openings, which correspond to the desired first layer of the structure to be printed. In this case, many such structures can be incorporated into the printing screen 11, so that several components or structural elements/structures simultaneously to a printing process can also be produced next to one another on the substrate 19 and/or the printing table 5.

After the first printing layer has been produced, the printing table 7 is, for example, moved downwards by the lifting device 6, and a further printing operation is carried out in which the same printing screen 11 is used to produce a further printing layer which has the same structure as the first printing layer. Optionally, instead of the same printing screen 11 one of the other printing screens 11 is used. For this purpose, the conveying arm 16 moves the printing screen 11 located in the screen receptacle 10 into the screen magazine 3, viz., into a screen storage portion 14 which is there free. The conveying arm 16 then removes another screen 11 from another printing storage portion 14 and feeds it to the screen receptacle 10 of the printing device 2. In a subsequent printing process, a printing layer, for example, is then produced which differs in shape from the previous printing layer. This principle makes it possible to produce several printing layers one above the other which differ from one another, as a result of which complex three-dimensional structures can also be produced. After each printing process has taken place, the printing table 5 is lowered a short distance, or, alternatively, the print head 9 is lifted a short distance.

Figure 2:
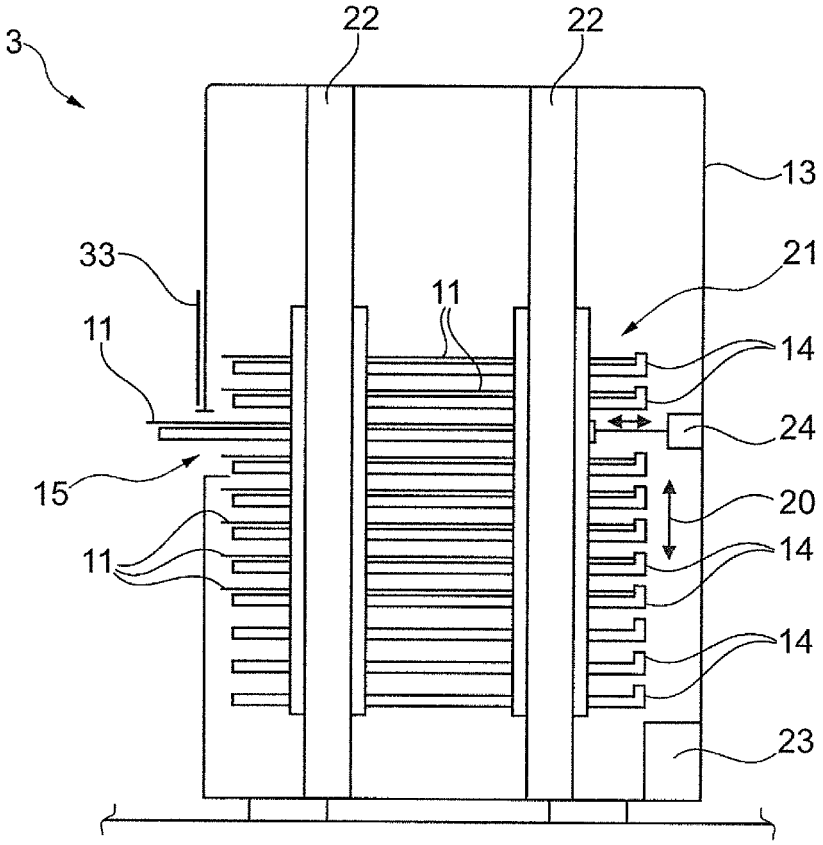
FIG. 2 shows a screen magazine of the printing system in a simplified representation.

While it is provided in the exemplary embodiment of FIG. 1 that the screen storage portions 14 be fixedly arranged in the housing 13, according to a further exemplary embodiment, which is shown in a simplified representation in FIG. 2, it is provided that the screen storage portions 14 be movable in height in the housing 13, as shown by a double arrow 20. For this purpose, the screen storage portions 14 can be displaced along vertical rails 22 by means of a lifting device 21. In this case, the removal opening 15 of the housing 13 is arranged approximately in the middle in the housing 13 and is designed to be narrow enough that only one printing screen 11 can be removed from or inserted into the housing 13 by the conveying arm 16.

If a specific printing screen 11 is to be removed from the screen magazine 3, the screen storage portions 14 are first moved or displaced vertically in such a way that this printing screen 11 is assigned to the removal opening 15 and can be removed from the conveying arm 16. The thereby essentially closed configuration of the housing 13 of the screen magazine 3 has the advantage that, in the screen magazine 3, there is a climate which improves the retention of the printing screens 11 in the screen magazine 3. Optionally, in the screen magazine 3, a conditioning device 23 is also arranged which has, for example, a cooling device or heating device, a humidifier, and/or a dehumidifier, in order to influence the climate in the screen magazine 3. In particular, the climate is influenced in such a way that residues of the printing compound remaining on the respective printing screen 11 are kept capable of being deposited. Drying is thus prevented. This has the advantage that the printing screens 11 can also be held in the screen magazine 3 over a longer period of time without having to be cleaned. As a result, the printing compound can also be intentionally left on the respective printing screen 11. Therefore, when filling the printing screen 11, less care must be taken that a maximum amount be used in order to avoid rejects or loss of the printing compound due to a later cleaning process. Instead, the printing compound is reused as soon as the printing screen 11 is removed from the screen magazine 3 and used as the basis for a further printing process. Of course, the conditioning device 23 can also be provided in the exemplary embodiment of FIG. 1. In principle, the conveying device 4 can be integrated completely into the printing device 2 or even completely into the screen magazine 3. Optionally, the conveying device is formed partially by the printing device and partially by the screen magazine 3. For this purpose, the screen magazine 3 has, for example, a sliding device 24, as shown by way of example in FIG. 2. The sliding device 24 is arranged at the level of the removal opening 15 and serves to advance a screen storage portion 14, lying at the height of the removal opening 15 and having a printing screen 11, or only the printing screen 11 in the direction of the removal opening 15 in such a way that the printing screen 11 projects beyond the housing 13 and thereby can be gripped particularly easily by the conveying arm 16. In the process, the conveying arm 16 is formed, for example, on the printing device 2. Optionally, the removal opening can be closed by a movable closing element 33.

In another exemplary embodiment, it can be provided that the sliding device 24 be designed in such a way that it pushes the printing screen completely through the removal opening 15 into the screen receptacle 10. If the removal opening 15 and screen receptacle 10 are aligned with one another, this can be realized in a simple and cost-effective manner The printing device 2 then, expediently, has a corresponding sliding device, which is designed to push the printing screen 11, after a printing process has been carried out, back into the screen magazine and the screen storage portion assigned to the removal opening 15.

Figure 3:
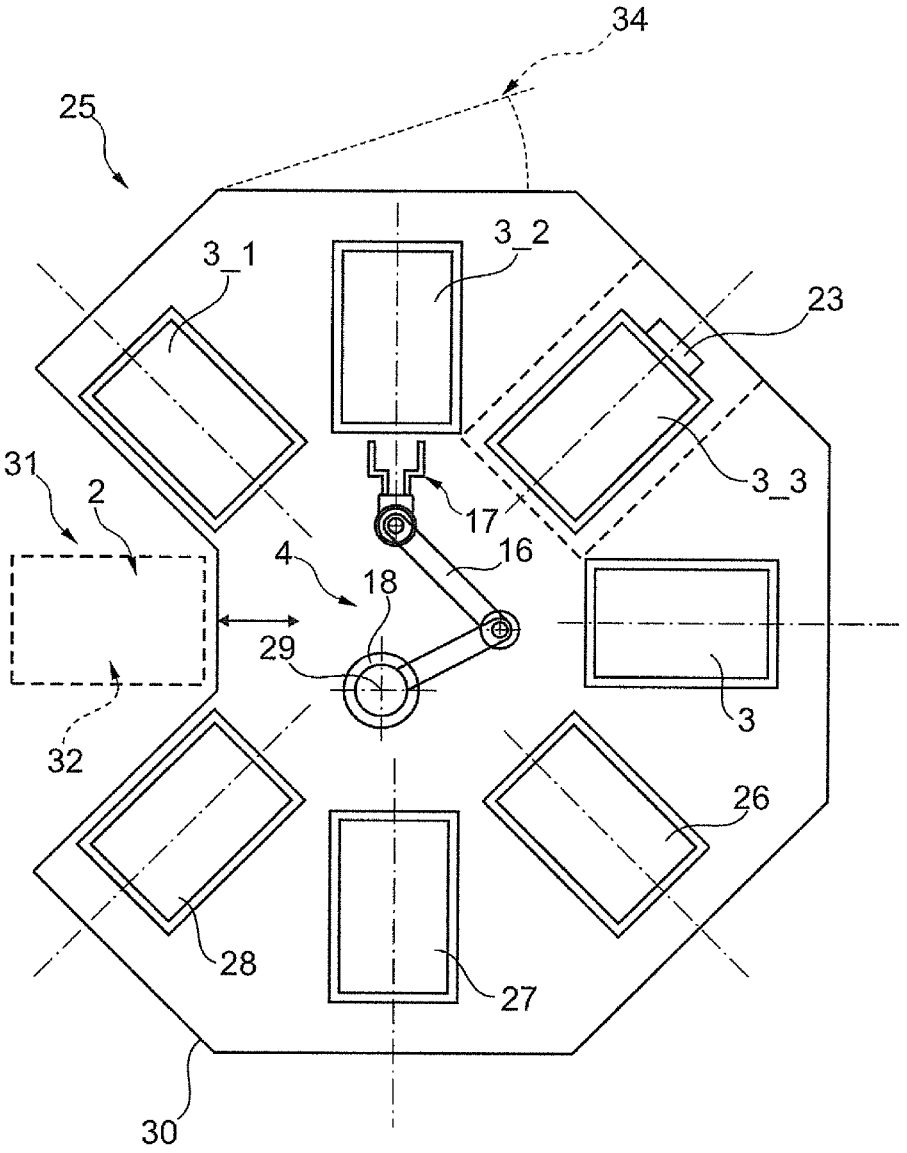
FIG. 3 shows an exemplary embodiment of a screen provision system for the printing system in a simplified top view.

In a simplified plan view, FIG. 3 shows advantageous screen provision systems 25, of which only the screen magazine 3 and the conveying device 4 are shown in FIG. 1. The screen provision system 25 advantageously has, in addition to the one screen magazine 3, further—in the present case, three further—screen magazines 3_1, 3_2, and 3_3. The screen provision system 25 also has several treatment stations 26, 27, and 28. The screen magazines 3 and the treatment stations 26 through 28 are arranged in a circular ring around the conveying device 4 so that a roundabout of modules arranged next to one another is produced, wherein the modules are distributed—in particular, uniformly—along a circumference, and, in particular, about the central axis 29 of the conveying device 4 or of the conveying arm 16.

The modules are housed together by a housing 30, which, optionally, has one or more maintenance doors 34 through which a user can access the screen provision system 25. Between two adjacent modules—in this case, the screen magazine 3_1 and the treatment station 28—a screen usage station 31 is arranged, which can likewise be supplied by the conveying device 4.

In the present embodiment, the screen usage station 31 is designed as the printing device 2. Alternatively, however, the screen usage device can also be embodied as a screen removal station 32, at which a selected screen from one of the screen magazines 3_1 through 3_3 or 3 can be made available to the user by the conveying device 4, so that the user manually moves this selected printing screen 11 to a desired printing device or to another use. A driving robot or a similar connection system can also be located at the screen usage station 31, through which an available printing screen can be supplied to a printing device or the like automatically. For example, the screen provision system 25 can be used as a central screen provision system in a printing hall having a plurality of printing devices. The screen provision system 25 can also be integrated into an In Line 3-D print line, wherein the screen usage station 31 then has, for example, the printing device 2, which is then designed for automatically conveying the carrier substrates into the printing device 2 and out of the printing device with three-dimensionally-shaped structures located thereon.

The treatment stations 26, 27, and 28 are, in particular, different treatment stations. In the present embodiment, the treatment station 26 is designed as a screen cleaning station. This is designed to clean a printing screen provided by the conveying device 4 and thereby remove all residues of printing compound from the printing screen. After the cleaning has taken place, the affected printing screen is brought back by, for example, the conveying device 4 into one of the screen magazines 3 through 3_3.

In the present case, the treatment station 27 is a screen filling station which is designed to fill a printing screen supplied to it with at least one ingredient or one material of a printing compound. This results in a centralized filling of the printing screens 11 by the screen filling station 27. In particular, this is designed to make different printing compounds or materials available, so that pre-filled printing screens with different printing compounds or printing materials can be made available by the screen provision system 25. In this, the conveying device 4 ensures the conveying of the respective printing screen to the screen filling station 27, and from this to, for example, the screen usage station 31. In this case, both cleaned printing screens and printing screens which have already been filled with a material, and thus optionally have printing residues, can be fed to the screen filling station 27. An identifier/identification feature arranged on the printing screens ensures that, on a printing screen which has already been filled and has not yet been cleaned, a material different from the previously applied material is obtained.

In the present case, the treatment station 28 is a control station which is designed, in particular, to measure a printing screen 11 supplied thereto and to check for damage. This makes it possible to ensure that, in the printing screen provision system 25, only printing screens which are properly formed and functioning are present and are output by the screen usage station 31.

The treatment stations 26, 27, and 28 preferably each have a screen storage portion to which the screen storage portion 14 corresponds or the screen receptacle 10 for receiving in each case one printing screen, in order to carry out the respective intended treatment. Optionally, fewer treatment stations or even more treatment stations may also be integrated into the printing screen provision system 25. The number of printing stations and screen magazines 3 described here is to be understood as merely an example. Advantageously, at least one screen magazine and at least one treatment station are present, in order to form the advantageous print screen provision system 25.

Optionally, one or more of the screen magazines 3, 3_1, 3_2, or 3_3—in the present case, at least the screen magazine 3_3—are provided with the conditioning device 23, in order to condition the printing screens located there and to maintain printing compound located thereon for later use.

What is claimed is:

1. A printing system comprising:

a printing device having a screen receptacle for a printing screen;

a squeegee device associated with the screen receptacle; and a screen provision system, the screen provision system comprising:

a screen magazine configured to store a plurality of printing screens, the screen magazine comprising multiple screen storage portions wherein each screen storage portion is configured to receive one of the plurality of printing screens; and a conveying device configured to convey the plurality of printing screens between the screen magazine and the screen receptacle, wherein the screen magazine has at least one displaceable closing element configured to move to release or close a housing enclosing the multiple screen storage portions, wherein the screen magazine comprises a conditioning device configured to generate or maintain a climate in the screen magazine to prevent drying of printing compound remaining on one of the plurality of printing screens accommodated within a storage portion of the screen magazine.

2. The printing system according to claim 1, wherein a screen usage station which can be supplied by the conveying device with the printing screens.

3. The printing system according to claim 2, wherein the screen usage station is a screen removal station for users.

4. The printing system according to claim 2, wherein the screen usage station is the printing device.

5. The printing system according to claim 1, wherein multiple screen magazines are present.

6. The printing system according to claim 5, wherein at least one screen magazine has at least one sliding device for advancing a selected printing screen and/or a screen storage portion.

7. The printing system according to claim 1, wherein the conditioning device has at least one humidifier and/or dehumidifier.

8. The printing system according to claim 7, wherein the conditioning device comprises the at least one humidifier, the at least one humidifier configured to maintain the climate preventing drying of the printing compound within the storage portion of the screen magazines.

9. The printing system according to claim 1, wherein the conditioning device comprises at least one cooling device and/or one heating device.

10. The printing system, according to claim 1, wherein multiple treatment stations are provided.

11. The printing system according to claim 10, wherein at least one treatment station is designed as a printing screen cleaning station.

12. The printing system according to claim 10, wherein at least one treatment station is designed as a printing screen filling station.

13. The printing system according to claim 10, wherein at least one treatment station is a control station.

14. The printing system according to claim 1, wherein the screen magazine further comprises a treatment station for treating the printing screens.

15. The printing system according to claim 14, wherein the conveying device is configured to convey the plurality of printing screens between the screen magazine, the screen receptacle, and the treatment station.

* * * * *